US005453577A

United States Patent [19]

Everett et al.

[11] Patent Number: 5,453,577

[45] Date of Patent: Sep. 26, 1995

[54] PNEUMATIC TOOL AND VIBRATION ISOLATOR MOUNTS THEREFOR

[75] Inventors: Richard J. Everett, New Hartford; David E. Huffaker, Sherrill; Kenneth McHenry, Clinton, all of N.Y.

[73] Assignee: Chicago Pneumatic Tool Company, Utica, N.Y.

[21] Appl. No.: 179,976

[22] Filed: Jan. 11, 1994

[51] Int. Cl.[6] ..... B25D 17/24

[52] U.S. Cl. ..... 173/211; 173/162.2; 173/168; 173/DIG. 2

[58] Field of Search ..... 173/162.1, 162.2, 173/211, 168, 169, DIG. 2; 30/381, 383

[56] References Cited

U.S. PATENT DOCUMENTS

| | | | |
|---|---|---|---|
| 3,372,759 | 3/1968 | Uebel . | |
| 3,525,373 | 8/1970 | Kobayashi | 30/381 |
| 3,968,843 | 7/1976 | Shotwell . | |
| 4,611,671 | 9/1986 | Hansson | 173/168 |
| 4,643,263 | 2/1987 | Karden | 173/168 |
| 4,936,394 | 6/1990 | Ohtsu . | |
| 5,027,910 | 7/1991 | Honsa et al. . | |
| 5,050,689 | 9/1991 | Dobry et al. | 173/162.2 |
| 5,052,500 | 10/1991 | Ohtsu . | |
| 5,157,807 | 10/1992 | Keller et al. . | |
| 5,213,167 | 5/1993 | Best et al. | 173/162.2 |

*Primary Examiner*—Scott A. Smith
*Attorney, Agent, or Firm*—Schmeiser, Olsen & Watts

[57] ABSTRACT

A pneumatic tool is disclosed which includes vibration mounts to reduce the vibration transferred to the user. The vibration mounts include a plurality of support members and at least one resilient vibration isolator connecting the support member in a spaced relationship. A compressed air conduit passes through the support member openings and includes at least one seal disposed between said support members and the air conduit.

8 Claims, 4 Drawing Sheets

PNEUMATIC TOOL AND VIBRATION ISOLATOR MOUNTS THEREFOR

BACKGROUND OF THE INVENTION

1. Field of the Invention

This invention relates generally to a pneumatic tool and vibration isolator mounts therefor. In particular, this invention relates to pneumatic tool and vibration isolator mounts which are adapted for mounting between the handle of the pneumatic tool and the tool housing to thereby reduce vibration transferred to the user.

2. Description of Prior Art

One of the difficulties of arriving at a vibratory isolator in a power tool is the problem of where to place the vibratory isolator in the tool. Some prior art devices have addressed this concern by placing the isolators in the housing, whereas others have placed the isolators at a joint between the grip handles and the housing.

In one particular prior art tool, an outer casing of rigid material is formed with a bell-shaped cavity therein. A motor housing is disposed in the cavity and isolated from the casing by elastomeric vibration-absorbing material which is pourable into the bell-shaped cavity between the motor housing and the outer casing. As the material cures, it becomes bonded to the interior surface of the casing and to the outer surface of the motor housing. The difficulty with this arrangement is that once the parts are bonded, they are difficult to interchange. Another drawback is that excessive vibration-absorbing material is required.

Another prior art vibratory dampening device on a power tool includes a dampening arrangement on a joint between a grip handle and a handle holder attached to the housing of the power tool. In this embodiment a large diameter shaped cup on a grip handle is disposed radially around the handle holder. Either the handle holder or grip handle includes radially outward or inward extending flanges to engage elastomeric vibration isolating dampers between the grip handle and the handle holder. This type of power tool is not usable with pneumatic tools since it lacks any features for providing a pneumatic seal between the grip handle and the handle holder.

One prior art pneumatic device discloses a pneumatic seal between the grip handle and the handle holder in a reciprocating pneumatic hammer. In this device, a handle is isolated from the body of the tool by a vibratory isolator. The isolator includes a rubber cushion member bonded to two steel coupling members, one of which is bolted to the handle and the other is bolted to the body of the tool. An air passageway extends through the handle and the cushion member for passage of air to reciprocate the hammer. Within the cushion member is an insert to provide an annular seal around the air pressure passage. A disadvantage of this device is that it is formed as an integral unit which may result in loss of sealing capabilities upon breakage. This joint is also designed for axially reciprocating loads and thus is questionable as to whether it could withstand substantial shear or torsional stresses when used with non-reciprocating pneumatic tools.

SUMMARY OF THE INVENTION

The present invention is an apparatus that provides all of the advantages sought by the prior art while almost totally eliminating the aforesaid disadvantages. The present invention provides to a pneumatic tool with vibration isolator mounts which reduce vibrations transferred to the user to less than 2.5 meters/sec$^2$ as tested by ISO 8662-1, ISO/DIS 8662-4 while assisting in reducing the noise level by approximately 10 db per PNEUROP 8N-1 dated 92-10-06 by means of an interchangeable muffler handle mounted to a vibration isolator mount. The vibration isolator mount of the instant invention also includes features to minimize the torsional, shear and axial stresses placed on the vibration isolators during improper assembly and use.

Another feature of the present invention is to provide an air conduit through the mount which effectively seals air without the disadvantage of vibrationally grounding the vibration source to the user. The air conduit of the present invention has the further advantage of providing O-ring grooves on its outer periphery to engage internal lips on the mounting plates of support members so as to maintain an air tight seal should the isolators become damaged.

These and other features and advantages of the present invention will become readily apparent as the same becomes better understood from the following detailed description when taken in conjunction with the accompanying drawings.

DETAILED DESCRIPTION OF THE PREFERRED EMBODIMENT

Figure 1:
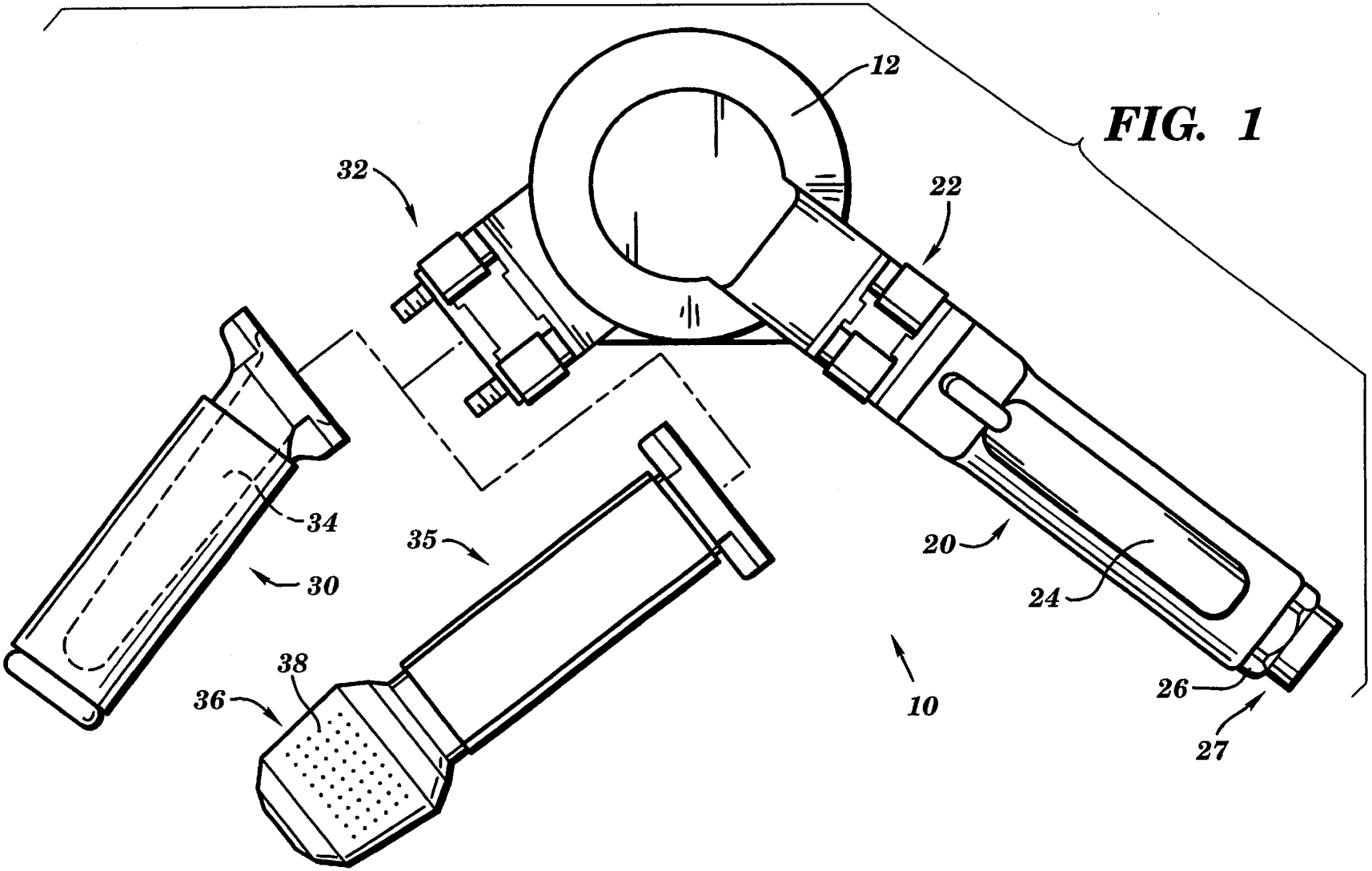
FIG. 1 is a top view illustrating a plurality of vibration isolator mounts of the present invention for isolating one of a plurality of handles from a vibratory source on a pneumatic tool.

FIG. 1 illustrates a top view of a pneumatic tool 10 such as a grinder, sander or polisher. The tool 10 includes a housing 12, a throttle handle 20, and a support handle 30. Optionally, the support handle 30 may be substituted for a support handle 35 with a muffler 36 extending therefrom. The throttle handle 20 is attached to the body of the housing 12 by throttle handle vibrator isolator mount 22 and the support handle 30 is attached to the housing 12 by support handle vibration isolator mount 32.

An air hose (not shown) is coupled to the end of the throttle handle 20 at inlet bushing 27. The inlet bushing 27 includes a tool engagement surface 26 such as a hex surface. The tool engagement surface 26 is proximate male threads (internal of handle 20 in FIG. 1) for coupling the inlet bushing 27 into the handle 20. Concentrically internal of the inlet bushing 27 are female threads for coupling an air hose to the handle 20. During operation, air passes through handle 20 via air passage 24 and then through the throttle handle vibration isolator mount 22 into a pneumatic motor inside the housing 12. Air is expelled from the motor in housing 12 into the air passage 34 in support handle 30 via support handle vibration isolator mount 32. Air from the air passage 34 then returns into the housing 12 where it is eventually expelled through an outlet (not shown) in the housing 12. Optionally, a support handle 35 with a muffler 36 may be attached to the housing 12. The foraminous openings 38 in the muffler 36 expel air that has passed through air passage 34.

Figure 2:
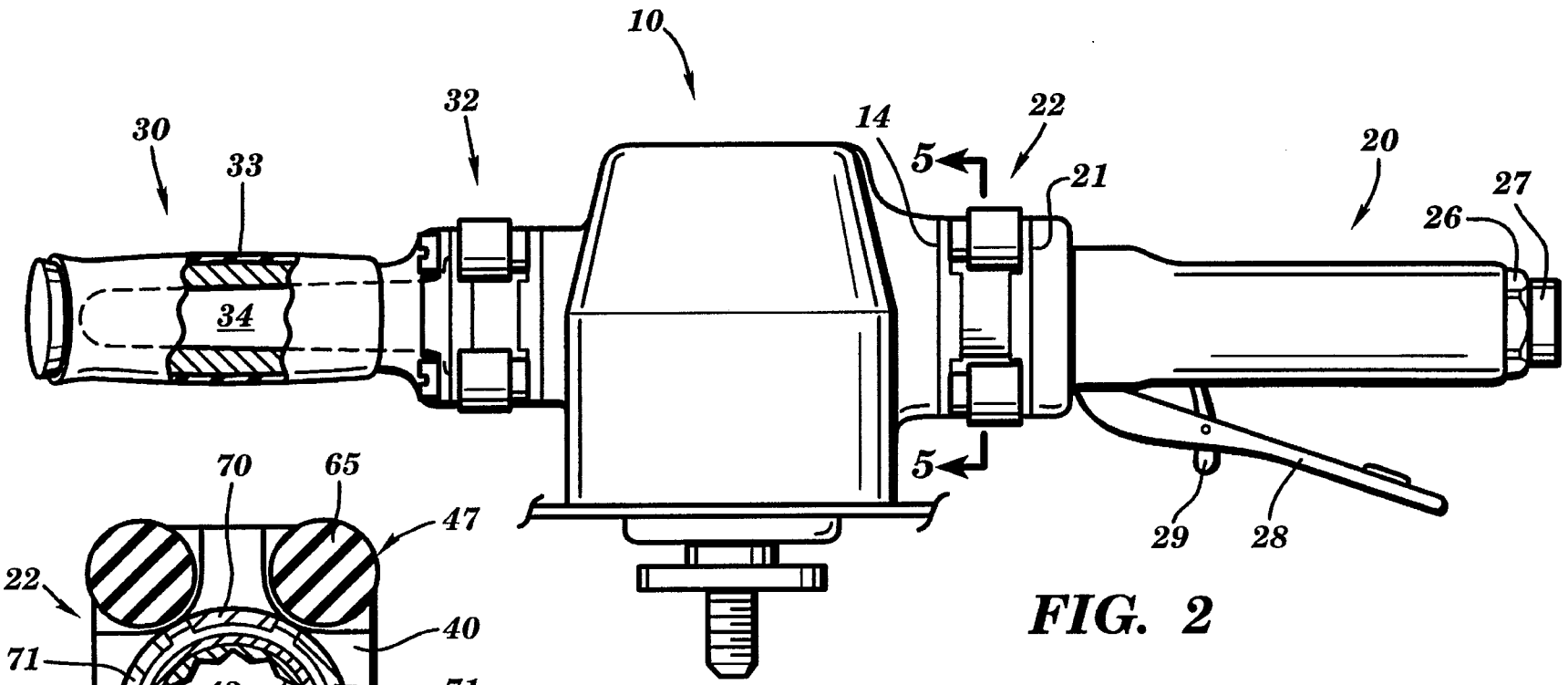
FIG. 2 is a side view illustrating a plurality of vibration isolator mounts of the present invention for mounting handles to a pneumatic tool.

FIG. 2 depicts a side view of the pneumatic tool 10 of the present invention. The pneumatic tool 10 includes a throttle lever 28 having a lock 29 thereon. The lock acts as a safety feature to prevent unintended operation of the tool 10. The support handle 30 also includes a handle grip 33 made of material such as foam rubber to enhance frictional grip of the user during use of the pneumatic tool 10.

Figure 3:
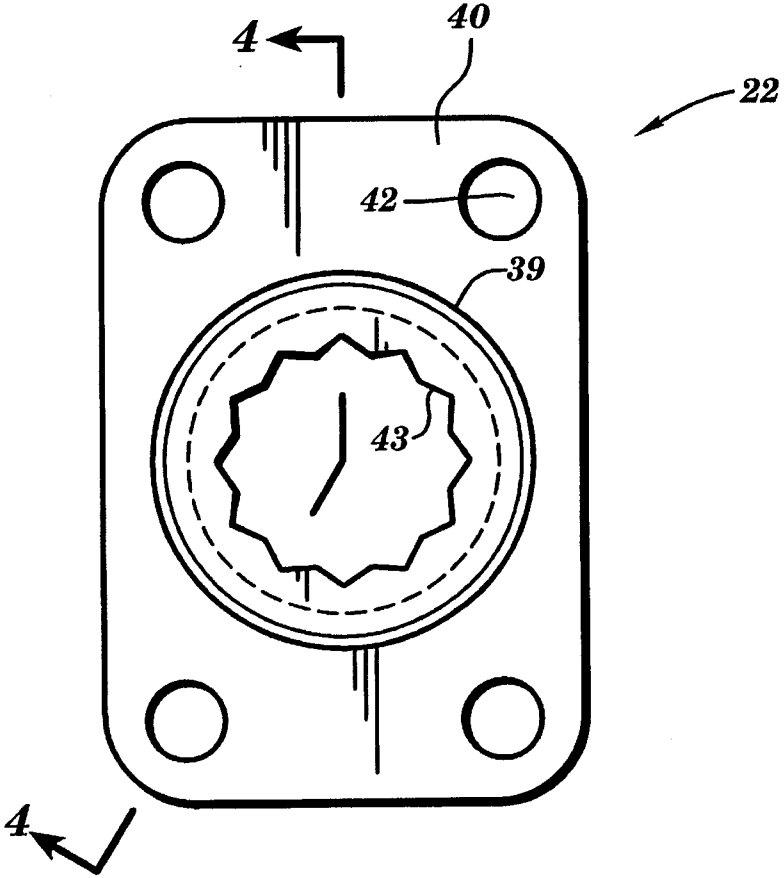
FIG. 3 is a front view of a throttle vibration isolator mount of the present invention.

FIG. 3 shows a front view of the throttle handle vibrator isolator mount 22. The throttle mount 22 includes a throttle handle plate or a first support member 40 having holes 42 therein. Centrally located on the throttle mount 22 is a 12-star splined tube 43 which extends through an opening 39 in the plate 40. The tube 43 defines an air passage therethrough.

Figure 4:
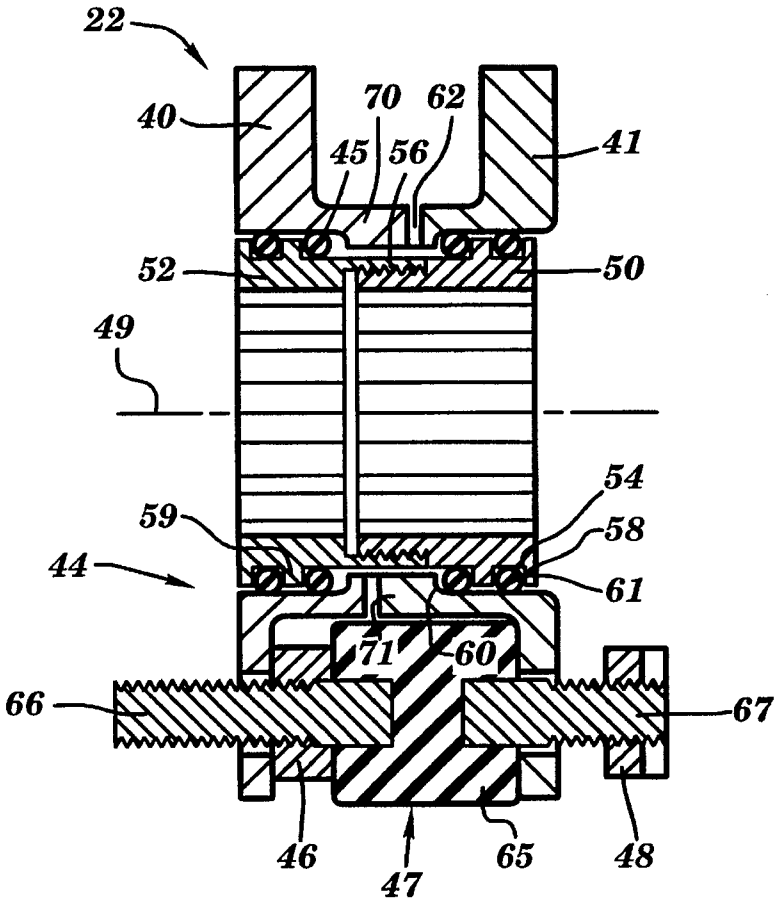
FIG. 4 is a side sectional view of a throttle vibration isolator mount of the present invention as taken through section 4—4 of FIG. 3.

A sectional side view of throttle handle vibration isolator mount 22 is depicted in FIG. 4 as taken through section line 4—4 of FIG. 3. The sectional view shows mounting plates or first and second support members 40 and 41. Mounting plates or support members 40 and 41 are mirror images of one another rotated 180 degrees about a central axis 49. Mounting plate 40 is positioned proximate the tool housing 12 and mounting plate 41 is positioned proximate handle 20. Gaskets 44 are mounted along the outside surfaces of the mounting plates 40, 41 proximate the housing mounting surface 14 and the handle mounting surface 21 for providing an air tight seal.

The inside diameters or openings 39 of the mounting plates or support members 40, 41 are defined by an annular recess 61 and an annular lip 60. Concentrically inward from the annular recess 61 and annular lip 60 of plate 41 is a male restraint 50. Axially opposite the male restraint 50 along axis 49 and concentrically inward from plate 40 is a female restraint 52. The restraints 50, 52 are coupled by threads 56 to provide a floating rigid compressed air conduit. The inner circumference of the restraints 50, 52 includes a 12-star splined surface 43 for tool engagement to tighten the restraints 50, 52 together. On an outer circumference of the male restraint 50 and female restraint 52 are depicted annular O-ring grooves 54 in which are mounted elastomeric O-rings 45. The O-rings 45 provide an air tight seal for air flowing through the center of the throttle mount 22. The grooves 54 are formed by annular rings 58, 59. The annular rings 58, 59 have a greater outside diameter than the inside diameter of the annular lip 60.

Adjacent the four corners of the throttle handle vibration isolator mount 22 are vibration isolators 47. The vibration isolators 47 fix the plates 40, 41 in a spaced relationship (space 62) such that they are not vibrationally grounded. The isolator 47 includes an elastomeric member 65 integrally formed on a plurality of lugs or studs 66, 67. A rounded slotted nut 48 is mounted on the stud 67 outside the mounting plate 41 on the side adjacent the handle 20. The opposite end of the vibration isolator 47 on stud 66 includes a nut 46 mounted inside the mounting plate 40.

Figure 5:
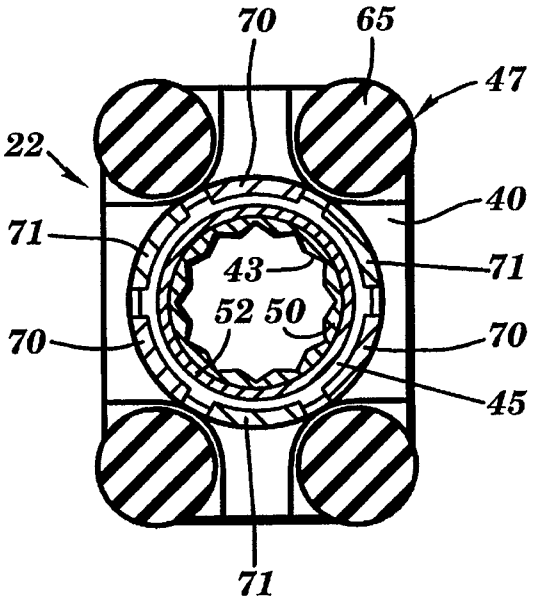
FIG. 5 is a sectional view of the throttle handle plate of the present invention as taken through section 5—5 of FIG. 2.

FIG. 5 shows a sectional view of the throttle handle vibration isolator mount 22 as taken through line 5—5 of FIG. 2. Mounting plate 40 includes axially extending castellated teeth 70 which are mounted in circumferentially spaced relationship to castellated teeth 71 on mounting plate 41. An important aspect of the invention is that the teeth 70, 71 are not vibrationally grounded to one another. Female coupling 52 is illustrated outside male coupling 50. O-ring 45 is positioned on the outer periphery of female coupling 52.

Figure 6:
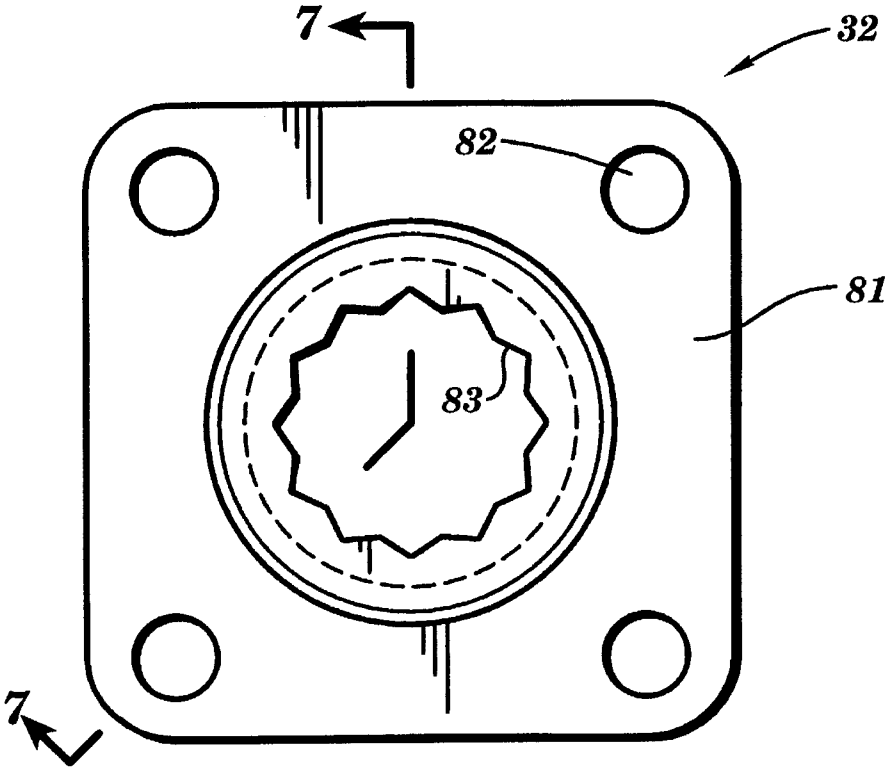
FIG. 6 is a front view of a support vibration isolator mount of the present invention.

FIG. 6 depicts a front view of the support handle vibration isolator mount 32. The support handle vibration isolator mount 32 includes mounting plate 81, an inner conduit surface 83 and isolator holes 82.

Figure 7:
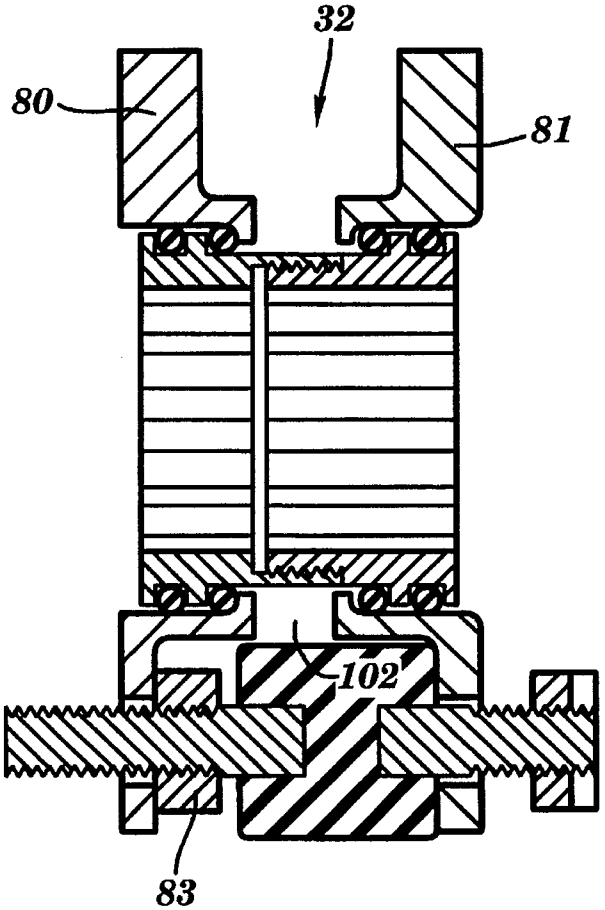
FIG. 7 is a side sectional view of a support vibration isolator mount of the present invention as taken through section 7—7 of FIG. 6.

As shown in FIG. 7, the support handle vibration isolator mount 32 is similar to the throttle handle vibration isolator mount 22 in many respects. The major difference between the two mounts is that the mounting plates 80, 81 have a large air gap 102 therebetween since they do not include castellated teeth thereon.

A significant feature of the throttle handle vibration isolator mount 22 of the present invention is the feature of the castellated teeth 70, 71 on the plates 40, 41. The castellated teeth 70, 71 minimize torsional and shear stresses applied to the vibration isolators 47 during improper assembly and disassembly of the air hose. During assembly of the air hose, a male threaded pipe fitting on the air hose (not shown) is coupled to a female threaded pipe fitting on the inlet bushing 27 (FIG. 1). A first tool such as a crescent wrench is used to apply torque to the male threaded pipe fitting on the air hose while a second tool such as another crescent wrench is used to engage the tool surface 26 of the inlet bushing 27 to stabilize the handle 20 from rotation. However, during improper assembly, the user may fail to use a second crescent wrench on tool surface 26. The torque applied to the air hose pipe fitting thus results in stresses translated to the vibration isolators 47. In order to minimize stress applied during inappropriate assembly, the castellated teeth 70, 71 act as rotational engagement surfaces to prevent further rotation of the throttle handle 20 to the vibration isolators 47.

Since an air hose is not applied to the support handle 30, 35, no need arises to provide rotational engagement surfaces or castellated teeth 70, 71 on the plates 80, 81 of the support handle vibration isolator mount 32.

Referring to FIG. 4, the throttle handle vibration isolator mount 22 is assembled by placing the vibration isolators 47 with nut 46 thereon on mounting plate 40. Plate 41 is then placed over studs 67. O-rings 45 are then placed on male 50 and female 52 restraints. The restraints 50, 52 are then inserted in the openings 39 of plates 41, 40 respectively. The restraints 50, 52 are then threaded together by a tool which engages surface 43. The studs 66 are then mounted on housing surface 14 and the handle is mounted on stud 67 with the handle's surface 21 engaging gasket 44. The throttle handle vibration isolator mount 22 is tightened by threading the nut 46 toward the housing surface 14 and the slotted round nut 48 is tightened to a surface on the handle 20 such that a flange on the handle rests between the nut 48 and the surface 21. The support handle vibration isolator mount 32 is assembled in a similar manner.

FIG. 4 illustrates the nut 46 in the pretightened position and FIG. 7 illustrates the nut 83 in the tightened condition. The air conduit comprised of restraints 50, 52 is intended to be in a an axially loose condition such that the lip 60 does not compress the O-ring 45 against the restraint ring 59 when the nuts 46, 83 are in their tightened positions. However, if the isolators 47 are damaged, the O-ring 45 will be compressed between the plate lip 60 and restraint ring 59 to prevent the handles 20, 30 from detaching from the housing 12 while still retaining the sealing effect of the O-rings 45.

Although a pneumatic grinder, sander, or polisher 10 is illustrated, other types of rotary or reciprocating pneumatic tools may be used with the vibration isolator mounts such as a rotary hammer, a hammer drill, a drill, or the like. The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

I claim:

1. A vibration mount for use with a pneumatic tool comprising:

a first support member having a first opening therein;

a second support member having a second opening therein;

at least one resilient vibration isolator connecting said first support member and said second support member in a spaced relationship; and a compressed air conduit, having first and second ends with openings therein, spaced from said at least one vibration isolator and passing through and sealed to said support member openings.

2. The vibration mount of claim 1, wherein the first and second support members include opposing rotational engagement surfaces.

3. The vibration mount of claim 2, wherein the rotational engagement surfaces are castellated teeth.

4. The vibration mount of claim 1, wherein the at least one vibration isolator includes a plurality of axially spaced studs joined by an elastomeric member.

5. A vibration mount in combination with a pneumatic tool, said vibration mount comprising;

a first support member having a first opening therein;

a second support member having a second opening therein;

at least one resilient vibration isolator connecting said first support member and said second support member in a spaced relationship; and a compressed air conduit, having first and second ends with openings therein, spaced from said at least one vibration isolator and passing through and sealed to said support member openings.

6. The combination of claim 5, wherein the pneumatic tool includes a plurality of interchangeable handles which are mountable on one of said first and second support members.

7. The combination of claim 5, wherein one of the handles includes a muffler thereon.

8. The combination of claim 5, wherein the pneumatic tool includes a first and a second vibration mount, said first mount having opposing rotational engagement surfaces included on said first and second support members.

* * * * *